US006533528B2

(12) United States Patent
Degen et al.

(10) Patent No.: US 6,533,528 B2
(45) Date of Patent: Mar. 18, 2003

(54) SUPPORT FRAME FOR FRONT ATTACHED IMPLEMENTS OF AN OPERATING MACHINE AND ASSOCIATED LOCATING PINS

(75) Inventors: Peter Degen, Sassenberg (DE); Mark Fallon, Homburg (DE); Ralph E. Shirley, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/877,895

(22) Filed: Jun. 8, 2001

(65) Prior Publication Data

US 2002/0031394 A1 Mar. 14, 2002

(30) Foreign Application Priority Data

Jun. 16, 2000 (DE) ..... 100 28 997

(51) Int. Cl.[7] ..... B66C 23/00
(52) U.S. Cl. ..... 414/723; 414/686; 172/272
(58) Field of Search ..... 172/272, 273, 172/274, 275; 414/723, 686; 403/230, 243, 256, 187, 188, 408.1

(56) References Cited

U.S. PATENT DOCUMENTS

| | | | | | |
|---|---|---|---|---|---|
| 3,417,886 | A | | 12/1968 | Stuart | |
| 3,512,665 | A | * | 5/1970 | Westendorf | 214/145 |
| 3,876,091 | A | | 4/1975 | MacDonald | 214/145 |
| 3,876,092 | A | | 4/1975 | MacDonald | 214/145 |
| 3,883,015 | A | | 5/1975 | Gorby | 214/145 |
| 3,934,738 | A | | 1/1976 | Arnold | 214/145 |
| 4,085,856 | A | | 4/1978 | Westendorf | 214/145 |
| 4,345,872 | A | * | 8/1982 | Arnold | 414/705 |
| 4,417,844 | A | | 11/1983 | de Pingon | 414/723 |
| 4,522,363 | A | | 6/1985 | Stuart | 248/225 |
| 5,107,610 | A | | 4/1992 | Fusco | 37/103 |
| 5,727,342 | A | * | 3/1998 | Horton | 37/468 |

FOREIGN PATENT DOCUMENTS

| | | |
|---|---|---|
| DE | A 25 59 293 | 7/1976 |
| EP | A 0 398 100 | 11/1990 |
| FR | 2690718 | 11/1993 |

* cited by examiner

*Primary Examiner*—Eileen D. Lillis
*Assistant Examiner*—Michael Lowe

(57) ABSTRACT

An implement support frame or holder is mounted to an end of a boom for swinging about a horizontal, transverse axis. A pair of transversely spaced, tapered locating pins are mounted to a horizontal, transverse member of the support frame. The pins are each provided with a front surface that is curved on a radius about the transverse pivot axis and a gradually tapering rear surface. The pins are symmetrical about a fore-and-aft extending vertical plane with the curved forward surface acting to aid in guiding the pins into circular receptacles provided in an upper rear horizontal member of the implement.

3 Claims, 3 Drawing Sheets

SUPPORT FRAME FOR FRONT ATTACHED IMPLEMENTS OF AN OPERATING MACHINE AND ASSOCIATED LOCATING PINS

FIELD OF THE INVENTION

The present invention concerns attaching implements to a support frame which is mounted to a boom end for pivoting freely about a horizontal transverse axis, and more specifically relates features of the support frame.

BACKGROUND OF THE INVENTION

In order to be able to attach front mounted implements, such as buckets, forks or the like, for free pivotal movement to the booms of tractor front end loaders, telescoping loaders or excavators, it is known practice to mount an implement holder or support frame to the boom of the operating machine for pivoting about a horizontal transverse axis. Arrangements for easy release of the front attached implements are provided on the support frame.

EP-A-0 398 110 discloses an arrangement for pivotally attaching a front attached implement to a boom of a loader. An implement holder is fastened over a rotary journal to the boom and can be pivoted about the rotary journal by a hydraulic cylinder. In the upper region of the holder, an upwardly opening, U-shaped receptacle is located which engages an upper transverse pin of the attached implement. The rotary journal projects on both sides of the holder so that its ends can engage receptacles in the implement that open to the rear. The rotary journals can be retained in the receptacles by a locking arrangement. For the mounting of the attached implement, the transverse pin is initially engaged by the support surface by movement of the holder. Then the holder is pivoted so that the ends of the rotary journals engage the receptacles. Following this, the ends of the rotary journals are locked in the receptacles. Here the lower attachment of the front attached implement to the support frame can be performed by a locking arrangement as has been described in DE-A-25 59 293.

It is also known practice from commercially available loaders to provide, in place of the support frame, a locating pin each that extends vertically upward and tapers to a cone shape, which engages in corresponding cylindrical recesses on the front attached implement. With this method of coupling, however, there is a disadvantage in that the vehicle must be positioned very precisely to the front attached implement in order to attain a secure coupling. Inappropriate handling could result in bending of the locating pin.

The task underlying the invention is seen in the need for defining a support frame and locating pin of the type defined above by means of which the aforementioned problems are overcome.

SUMMARY OF THE INVENTION

According to the present invention there is provided an improved implement holder or support frame of the type including a tapered locating pin.

It is an object of the invention to provide a support frame, having a locating pin, that is so constructed that the process of introducing the locating pin into a receptacle of a front attached implement is simplified to the extent that there is no need to precisely position the vehicle relative to the front attached implement in order to avoid damage to the locating pin.

A more specific object of the invention is to provide a support frame with a locating pin, as defined in the immediately preceding object, wherein the pin further includes a forward surface that is curved on a radius about the axis of the pivotal connection of the support frame with a boom of a work vehicle so that the support frame may be more easily manipulated to place the locating pin within a receptacle provided on the implement designed for attachment to the support frame.

These and other objects will become apparent from a reading of the ensuing description together with the appended drawings.

DESCRIPTION OF THE PREFERRED EMBODIMENT

Figure 1:
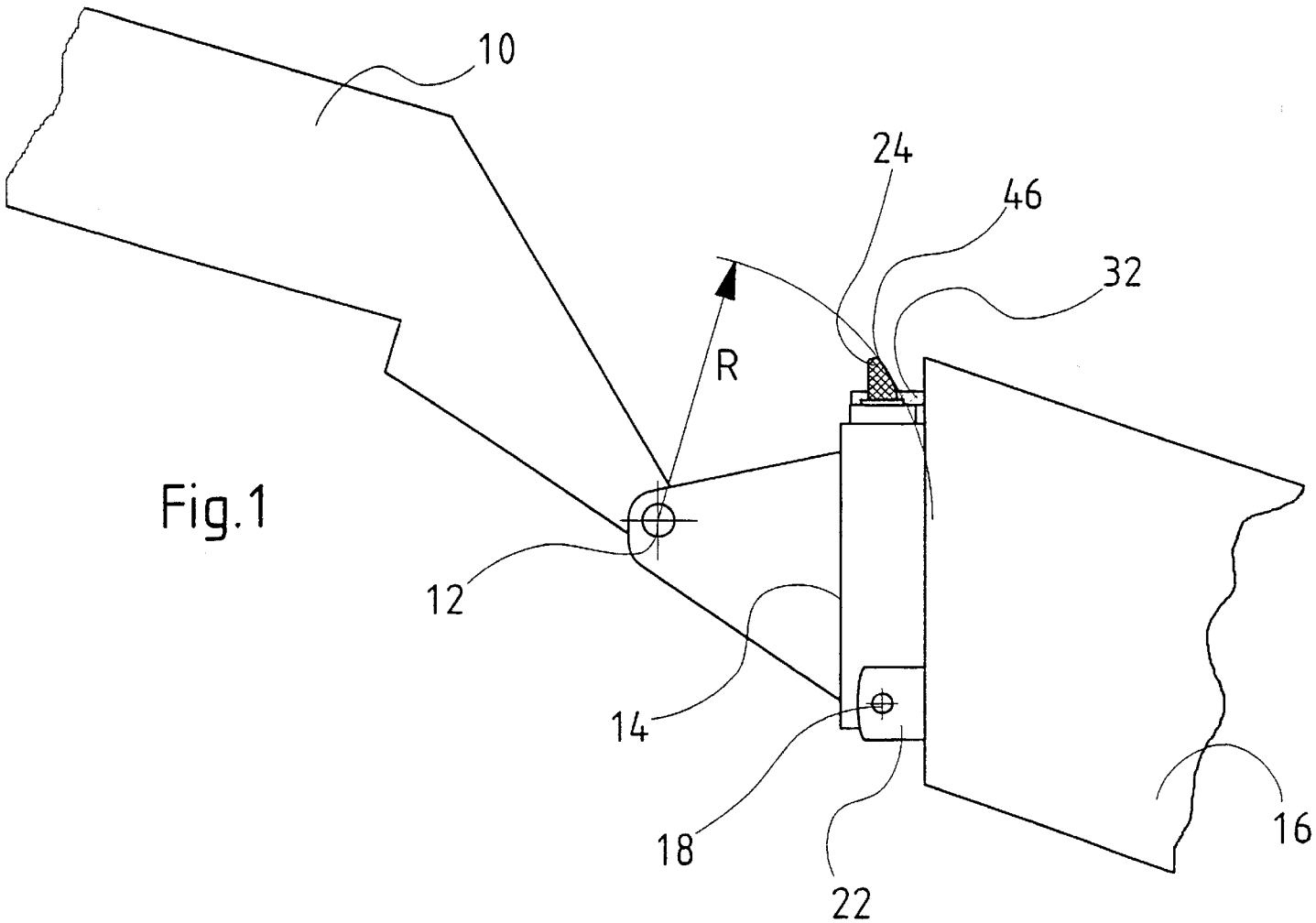
FIG. 1 is a somewhat schematic right side elevational view of the boom of an operating machine with a support frame constructed in accordance with the present invention.

Referring now to FIG. 1, there is shown a boom 10 of an operating machine, not otherwise shown, which may be of a commercially available telescoping loader, for example. At the front end of the boom 10, an implement support frame or holder 14 is fastened, free to pivot about a transverse pivot axis defined by a journal assembly 12. The pivoting of the support frame 14 can be performed in the usual manner by one or two hydraulic cylinders, not shown. An attached or front implement 16, shown only partially, for example, a shovel, is rigidly fastened to support frame 14.

Figure 2:
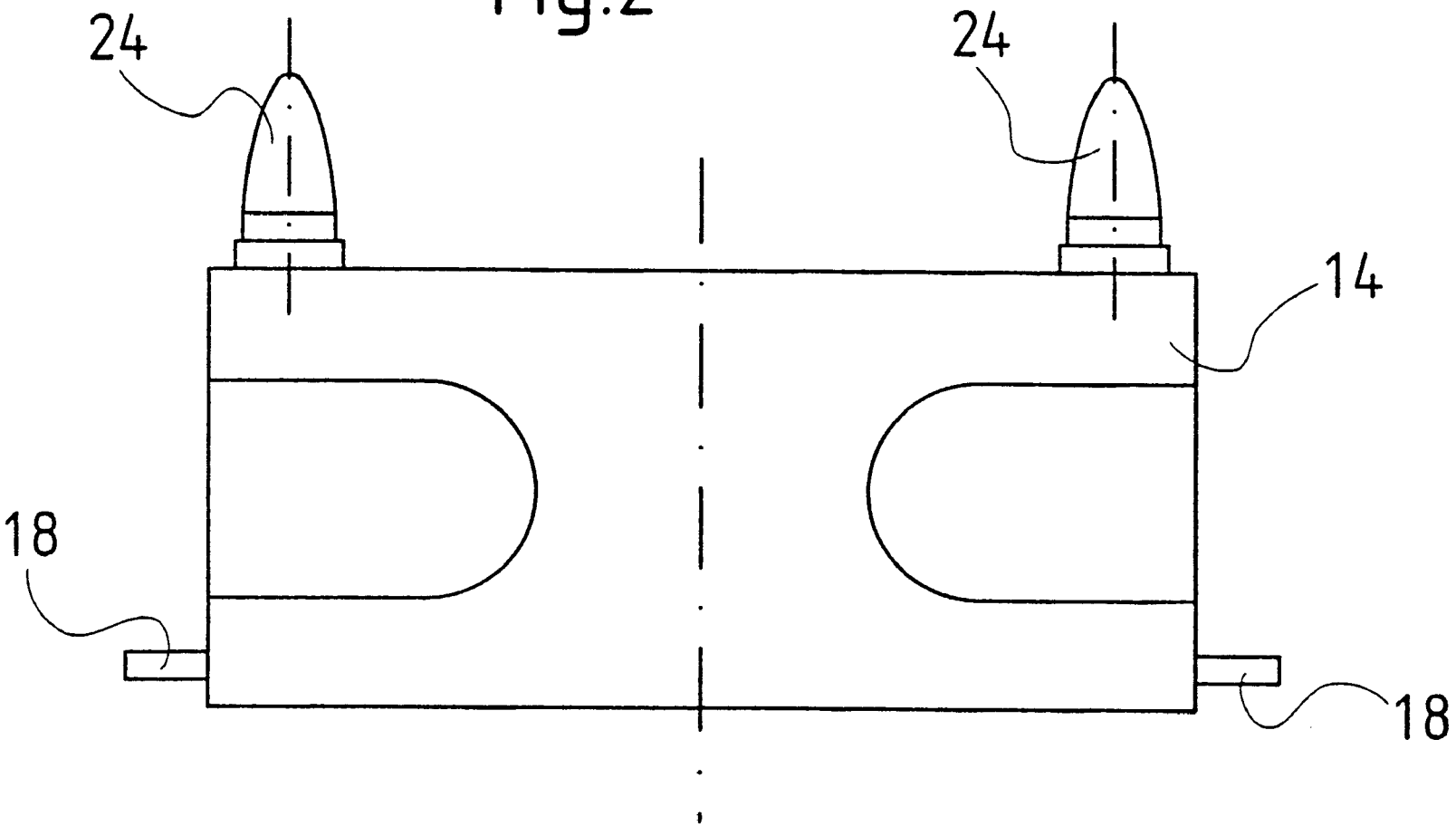
FIG. 2 is a front view of the support frame shown in FIG. 1.

As can be seen from FIG. 2, two pins 18 project from the side of the lower region of the support frame 14. When the front attached implement 16 is mounted, these pins 18 engage bores which extend transversely through vertical brackets 22 located at the rear of, and forming part of, the front attached implement 16. For mounting or dismounting of the front attached implement 16, the pins 18 can be retracted or extended in the axial direction by an appropriate arrangement as is revealed, for example, by DE-A 25 59 293.

On the upper edge of the support frame 14, a locating pin 24 extending vertically upward is fastened to each side. The fastening can be performed, for example, by welding. Other methods of fastening, for example, by bolting are also possible. With this positioning of the locating pins 24, the pins are easily visible from the vehicle cab and can be easily engaged in the receptacles of the front attached implement 16.

Each locating pin 24 is provided with a mounting base 26, in the form of a flange, and, vertically above that, an adjoining cylindrical region 28 of smaller diameter, which blends without any step into an essentially conical region 30. The base 26 of the locating pin 24 is fastened to the support frame 14. When the front attached implement 16 is mounted, the cylindrical region 28 engages a cylindrical bore that is defined in a bracket 32 extending generally in the horizontal direction in the rear, upper region of the implement 16.

Figure 3:
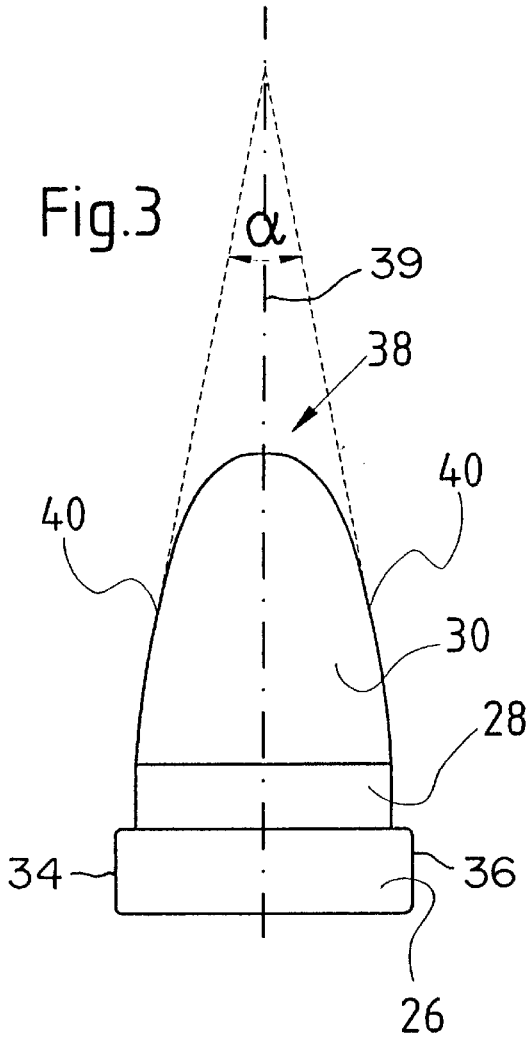
FIG. 3 is a front view of a locating pin of the present invention.

The locating pin mounting base 26 is generally cylindrical and is flattened on laterally opposite sides 34 and 36. As can be seen from FIGS. 2 and 3, the profile of the conical region 30 of the locating pin 24 is configured symmetrically relative to a vertical plane 39, extending fore-and-aft or in the direction of the boom 10, and tapers towards the upper, free end 38 of the pin, generally in the form of a cone. Here the side edges 40 of the cone are not straight lines, but are curved slightly in the convex direction They include a mean taper angle $\alpha$ of approximately 35°.

Figure 4:
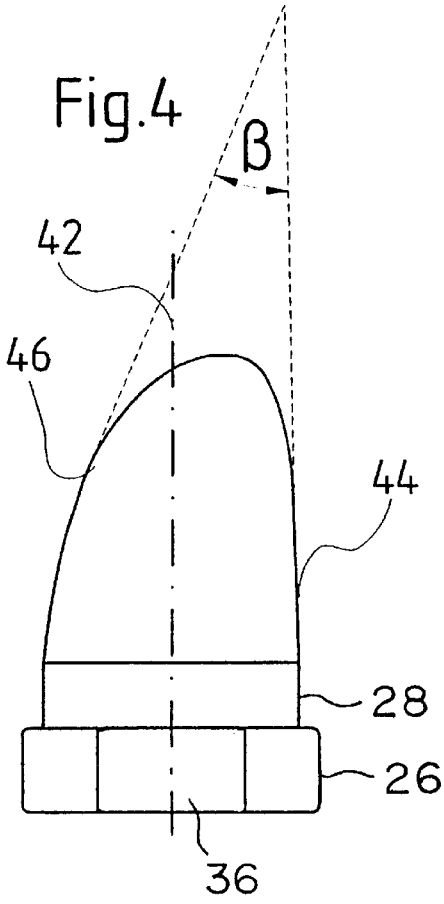
FIG. 4 is a side view of the pin shown in FIG. 3.

As can be seen from FIG. 4, the profile of the conical region 30 of the locating pin 24. is asymmetrical to a transverse vertical plane 42 bisecting the base 26 and cylindrical region 28. The locating pin 24 tapers on its rear side 44, which faces the boom 10, only slightly towards the upper end, while the taper on the front side 46 is relatively strong. Here the tapered regions of the rear side 44 and the front side 46 are not straight lines, but are curved slightly in the convex direction. They include a mean taper angle $\beta$ of approximately 30°. Hence, the locating pin 24 is not rotationally symmetrical, but is configured asymmetrically. However, the taper ratios with respect to the transverse cross section and the longitudinal cross section of the locating pin 24 are therefore in the same order of magnitude and differ relatively little from one another. This configuration leads to an optimum force distribution in the locating pins 24 since they have a relatively thick cross section throughout their tapered sections.

The above-described configuration of the locating pins 24 considerably improves the engagement of the front attached implement 16. When the pins 24 are introduced into the respective receptacles of the front attached implement 16, it is not necessary that the support frame 14 and the attached implement 16 be aligned precisely with each other. Due to the asymmetric configuration of the outer contour of the locating pins 24, this shape conforms to the circular movement through which the support frame 14 moves during the process of positioning the pins 24 within the receptacles of the implement 16. Due to this configuration, the front attached implement 16 can be engaged more rapidly, faster and safer. Evidence of wear and, in particular, bending of the location pins is largely avoided.

Preferably, the front side or flank 46 of the locating pin 24 forms essentially a circular arc whose radius R is equal to the distance between the front side 46 and the pivot axis 12 of the support frame 14. During the engagement of the front attached implement 16, the support frame 14 is pivoted about its pivot axis 12. Due to the circular arc configuration of the front side 46, this conforms optimally to the pivoting movement, so that during the engagement relative sliding between the support frame 14 and the front attached implement 16 can be largely avoided, whereby the locating pin 24 is loaded relatively little.

Figure 5:
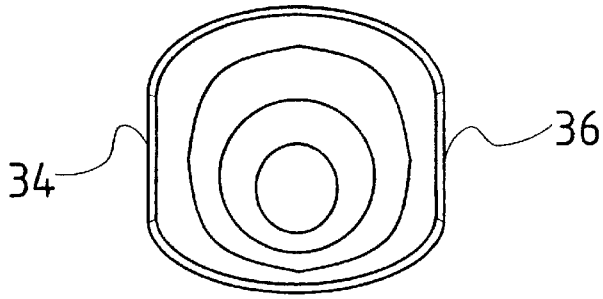
FIG. 5 is a top view of the in shown in FIG. 3

The upper region of the locating pin 24 approaches a ball shape, but at its outer most end region 38 it is configured with a slight flat. The circumferential outer contour of the locating pin 24 is rounded on all sides. Thereby pin cross sections that extend transverse to the axis 42 of the pin are essentially circular, as indicated in FIG. 5.

In order to fasten the front attached implement 16 to the support frame 14, the support frame 14 is lowered and the telescoping loader is maneuvered in such away that the locating pins 24 are positioned underneath the bores of the horizontal bracket 32. Then the support frame 14 is pivoted upward about the pivot axis 12 whereupon the locating pins 24 enter the bores and the upper edge of the support frame 14 lifts the front attached implement 16. As soon as the side pins 18 are aligned with the associated bores of the vertical brackets 22, they are extended and engage these bores and lock the front attached implement 16 to the support frame 14.

Although the invention has been described in terms of only one embodiment, anyone skilled in the art will perceive many varied alternatives, modifications and variations in light of the above description as well as the drawing, all of which fall under the present invention.

Having described the preferred embodiment, it will become apparent that various modifications can be made without departing from the scope of the invention as defined in the accompanying claims.

What is claimed is:

1. In an implement support frame having a coupling arrangement adapted for establishing a pivotal connection, defining a transverse pivot axis, with an end of a boom of a working vehicle, at least one tapered locating pin having an at least substantially conical surface extending substantially over an entire length of said locating pin between fixed and free ends of said locating pin, and said locating pin being spaced from said pivotal coupling arrangement and adapted for being releasably engaged with a receptacle provided in a front attached implement, the improvement comprising: said at least substantially conical exterior of said at least one tapered locating pin having a substantially conical profile being symmetrical relative to a vertical, fore-and-aft extending plane, and being asymmetrical relative to a vertical transverse plane; and said locating pin further having a rear side, adapted for facing said boom, that tapers relatively slightly, and a front side that tapers relatively sharply approximately in a circular arc having its center at said pivot axis.

2. The implement support frame defined in claim 1 wherein said at least one locating pin has a cylindrical region which blends, without any steps, into a region that tapers toward said free end of said pin, said cylindrical region being adapted for being received in a complementary shaped receptacle of said implement.

3. The implement support frame defined in claim 2 wherein said at least one locating pin has a mounting base defined by a cylindrical flange region that is larger in diameter than, and is joined to said cylindrical region.

* * * * *